US008291626B2

(12) United States Patent
Yang

(10) Patent No.: US 8,291,626 B2
(45) Date of Patent: Oct. 23, 2012

(54) IRON WITH MAGNETIC HEEL REST TO PREVENT TIPPING

(76) Inventor: Hong S. Yang, Pleasanton, CA (US)

( * ) Notice: Subject to any disclaimer, the term of this patent is extended or adjusted under 35 U.S.C. 154(b) by 135 days.

(21) Appl. No.: 12/844,753

(22) Filed: Jul. 27, 2010

(65) Prior Publication Data

US 2012/0023790 A1 Feb. 2, 2012

(51) Int. Cl.
*D06F 75/40* (2006.01)
*D06F 75/30* (2006.01)

(52) U.S. Cl. ..... 38/79

(58) Field of Classification Search ..... 38/79, 96; 248/117.1–117.7; 219/246, 259; D32/73
See application file for complete search history.

(56) References Cited

U.S. PATENT DOCUMENTS 2,418,020 A * 3/1947 Finlayson ..... 38/79
2,449,318 A * 9/1948 Pitman et al. ..... 219/246
2,602,247 A 7/1952 Cochran
3,443,780 A 5/1969 Bruening
3,599,358 A 8/1971 Butts et al.
3,760,149 A * 9/1973 Harsanyi ..... 219/247
5,619,812 A 4/1997 Hensel et al.
5,721,418 A * 2/1998 Hazan et al. ..... 219/257
6,321,472 B1 11/2001 Perko et al.

FOREIGN PATENT DOCUMENTS

FR 2724950 A1 3/1996

* cited by examiner

*Primary Examiner* — Ismael Izaguirre
(74) *Attorney, Agent, or Firm* — Proxigee Legal Transactions; Elizabeth A. Nevis, Esq.

(57) ABSTRACT

A hand-held cloth iron, heated or not, can cause injury or damage if it falls. An improved iron includes a magnetic heel rest. A magnetic pull force occurs between the heel rest and the ferromagnetic steel top of an ironing board when the iron is stood on its heel. The magnets are strong enough to stabilize the iron, even on a board with a padded cover, without impractically impeding the operator's normal ironing motions. The magnetic rear plate can either be coplanar or slightly recessed with respect to the outer surface of the heel rest. The depth of the recess can be made adjustable to correspondingly adjust the strength of the magnetic pull force to suit a user's preference.

18 Claims, 12 Drawing Sheets

| Electric Irons | R1 | **M1 (with Magnetic Heel Rest)** |
|---|---|---|
| Board Angle at Tipping over | $15^{o}$ | **$45^{o}$** |
| Electric Irons | R2 | **M2 (with Magnetic Heel Rest)** |
| Board Angle at Tipping over | $12^{o}$ | **$32^{o}$** |

FIG. 12

IRON WITH MAGNETIC HEEL REST TO PREVENT TIPPING

BACKGROUND

Related fields include hand-held irons for pressing fabric, and more specifically safety features and attachments for such irons.

A hand-held cloth iron consists essentially of a heated soleplate with an insulated handle. The operator grasps the handle and presses or slides the soleplate against a wrinkled fabric article—for example, a garment—to remove the wrinkles. The fabric is normally arranged for ironing on a purpose-built ironing board. Such a board typically has a flat working surface manufactured from sheet metal and covered by a fitted, padded ironing board cover. The padded cover functions as thermal insulation between the ironing board and the high-temperature iron so that heat is not dissipated by conduction through the metal of the board. The cover also fills in any unevenness in the metal surface of the board, providing a smooth and soft surface for the fabric, even if the metal board underneath the pad is honeycombed or otherwise perforated to reduce its weight and allow steam to flow through.

While ironing, the operator must often let go of the iron to reposition or exchange the wrinkled article, to apply starch or iron-on materials, or for some other reasons. If the soleplate of the iron remains in contact with the ironing board cover for too long, sufficient heat will accumulate to scorch, burn or ignite the cover. Furthermore, if the soleplate is accidentally left at rest on the wrinkled article—which can easily occur in a household or backstage environment where interruptions are many and varied—the article, which is typically less heat-resistant than the board cover, can sustain thermal damage in less than a minute.

To avoid such damage, the wider end of most irons, often called the "heel" or "heel rest," is configured so that the iron can be balanced in an upright position with the soleplate substantially perpendicular to the ironing board surface. In this position, the soleplate delivers almost no heat to the article being ironed or the ironing board cover. To improve the stability of the iron resting on its heel, the soleplate (the heaviest component of the iron) forms a slightly acute angle with the heel rest so that the soleplate is tilted at slightly more than 90° to the board and "leans" on the handle or an extension of the handle or body. Nevertheless, because a standard iron soleplate is still significantly longer than the heel is wide, an iron resting on its heel has a high center of gravity, which makes it vulnerable to tipping if the iron or board is bumped, wobbled, or tilted. Ironing often takes place in close and busy quarters and most modern ironing boards are narrow, lightweight and collapsible; therefore mild to moderate perturbations in the form of bumps, wobbles, or tilting are far from rare.

Because an iron is heavy and pointed at one end, as well as very hot when in use, a falling iron can inflict a variety of injuries on nearby persons or domestic animals, as well as damages to properties. In addition, a steam iron left in its vertical position may tip and leak water from the pores of the soleplate onto an item, thus possibly staining the item. Accordingly, it is desirable to have an iron which will remain more stable in its upright position.

This need for ironing safety has long been recognized and addressed in various ways. For example, many electric irons have automatic shut-off devices that disconnect power from the soleplate heater when the iron has been idle for a fixed period of time, such as 10 minutes. The automatic shut-off cycle saves energy and prevents such accidents as being burned from touching an iron last used hours before and believed to be cold. However, as noted above, many fabrics and other surfaces can sustain thermal damage long before the expiration of the timing cycle if they are in direct, stationary contact with a hot soleplate. On the other hand, reducing the automatic shut-off time enough to avoid such damage would cause the iron to shut itself off almost constantly, prolonging the time to iron a batch of articles and frustrating the operator. Some irons use motion sensors or accelerometers to reset the automatic shut-off timer whenever the user moves the iron. One disadvantage of this type of iron is that it automatically shuts off when held motionless by the user, which is necessary for some operations such as activating fusible-web materials or setting fabric paints. Also, such an iron may not function properly on an uneven surface such as a wool jacket with pockets and cuffs.

Ironing board stability has been improved by widely-spaced and heavy-duty tubular steel legs and non-slip grip feet. Additionally, ironing boards with an iron keeper or holder topped or lined with heat-resistant materials such as high-temperature silicone are commercially available. However, the iron holder usually is positioned far away from the pointed end of the board where clothing must often be positioned to smooth areas near sleeves, legs, and necklines, so that it is inconvenient to use. In addition, the iron holder reduces the ironing surface at the square end of an ironing board, which is useful for pressing the backs of shirts and the like.

There have been many attempts in the prior art to provide iron keepers or holders as part of an ironing board to securely retain an iron on an ironing board in a temporarily unused position. Most of these attempts have been directed toward mechanical means which have required some additional movements, other than normal ironing hand motions, by the user to latch the iron to the ironing board to secure it and unlatch the iron from the ironing board to remove it. Other attempts at the use of magnetic force for iron rests are described in U.S. Pat. Nos. 3,443,780 and 3,599,358 and French Pat. No. 2,724,950. These patents show an ironing board which has a magnet acting as a keeper interacting with a conventional iron. The application of a magnetic plate would clearly create an obstruction to the user and thereby reduce either the area available for ironing or, where the keeper is cantilevered from the edge of the board, the free edge over which fabric may smoothly drape without acquiring more wrinkles. Most of the iron keepers are typically secured in one position on the ironing board, thus requiring the operator to reach for the iron keeper each time the iron is removed or replaced on the keeper. When ironing for a considerable period of time, much time and effort is wasted by these reaching movements. Many cycles of leaning and reaching while holding a heavy iron at arm's length may eventually cause the operator a repetitive-motion injury. When the ironing surface is so large the operator must stretch to reach the iron keeper, even a single unguarded motion may cause a muscle strain or even a fall. Therefore, mechanical or magnetic keepers mounted on ironing boards have not been commercially successful.

Other attempts at iron keepers have been made that do not require the operator to perform the extra motion to always return the iron to the same location. Some irons automatically disengage the soleplate from contact with the article being ironed or the ironing board cover when the iron is not being used. Specifically, U.S. Pat. No. 2,602,247 shows a self-tilting iron incorporating a strong electromagnet to work in conjunction with the ferromagnetic steel board of an ironing board to force the entire iron to tilt away from the ironing board and sit upon the inclined heel rest of the iron when it is not in use, and the magnetic attraction between the iron and the board then secures it against tipping. This attempt of using an electromagnet proved unsatisfactory because of the significant increases in the weight, cost and bulkiness of the iron.

In an effort to improve the heel rest of an electric iron, Perko et al in U.S. Pat. No. 6,321,472 and Hensel et al in U.S. Pat. No. 5,619,812 disclosed an iron with a heel rest having a recess of ~2.5 mm in the outer surface so that the iron will be less likely to tip over while in its upright position on a soft surface. In such case, as the weight of the iron forces the soft surface downwards, the portion of the soft surface directly underneath the recess moves upward to fill in the recess. As a result, the soft surface in the recess interlocks with the recess in the heel to help prevent the iron from tipping over. Rubber feet are also placed on the heel rest to add stability. However, the improvement with this type of heel rest in preventing tipping is rather miniscule.

Various auto-lifting electric irons with different elevation mechanisms and support means to prevent tipping of the irons are disclosed in U.S. Pat. Nos. 7,546,701, 7,406,783, 6,925,738 and 6,453,587 issued to Alipour, U.S. Pat. No. 6,715,222 to Hecht, and U.S. Pat. Nos. 6,260,295 and 6,105,285 to Nickel. When a sensor indicates that the iron's handle is not being gripped, an elevating mechanism extends support means from the soleplate to lift the soleplate up off the ironing board. When the sensor senses that the handle is being gripped, the mechanism retracts the support means to a position inside the iron. The lifting or elevating mechanism is optimized so that it does not cause the iron to roll over on its side when the iron is laid flat on its soleplate. The iron always remains in a stable horizontal position irrespective whether the iron is in use or not. Unfortunately, the auto-lifting mechanism is mechanically and electrically complex and cumbersome, and it makes an iron much heavier. In a modern iron, the available space is generally taken up by controls for steaming, spraying, and the like and the remaining space is rather unsuitable to house complex mechanisms. Basic functions such as heating up water and soleplate quickly, fast steam generation and no leaking of water, can be easily compromised by the auto-lifting function. Reliability of the moving mechanical parts is also a concern considering the repeated uses of the iron for years. Furthermore, for many users the auto-lift function can be a nuisance unless the user manages to get used to leaving such iron with the heating surface down.

It would, therefore, be highly desirable to provide an iron that is extremely stable against tipping without adding excessive weight, size or complexity, and without requiring operators to learn new methods or perform extra motions. Preferably the iron would also be convenient to use, aesthetically pleasing, inexpensive to manufacture, simple and compact in size, and capable of incorporating popular performance features found in contemporary irons. However, in view of the art considered as a whole at the time of the present invention was made, it was not obvious to those of ordinary skill in this art how to provide an iron meeting all these requirements.

SUMMARY

A need exists for an iron that overcomes the aforementioned deficiencies of prior art irons. An iron described herein has an improved heel rest to prevent tipping. This iron can rest securely on the improved heel, anywhere on the top surface (ironing surface) of an ironing board in a vertical orientation that removes the heated soleplate from the board cover and article being ironed. The stable heel rest is inexpensive to fabricate. Because it adds no significant extra weight and requires no major change in iron size, iron shape, or operators' accustomed ironing motions, consumer acceptance is highly likely. Therefore, iron manufacturers will probably find this heel rest attractive to incorporate into their products.

An improved iron includes a soleplate, a water tank mounted to the soleplate for supplying steam to the soleplate, a handle joined with the water tank, a heel rest connected to the rear end of the water tank, a rear plate as a part of the heel rest and in covering relation to the rear portion of the iron, and one or more magnets embedded in the rear plate to generate a magnetic field, producing a magnetic pull force between the magnets and the magnet-attracting, ferromagnetic steel top of an ironing board and thus stabilize an iron standing on its heel. The magnetic rear plate can either be coplanar or slightly recessed with respect to the outer surface of the heel rest, and the amount of recess can be made adjustable by mechanical means so that the magnetic pull force between the magnetic heel rest and the ferromagnetic steel top of an ironing board can be adjusted by a user to suit his or her preference.

A stand-alone magnetic heel rest with its size and shape fitting the heel of an existing electric iron is provided, which can be attached to the heel of the iron using conventional fastening means.

The magnetic heel rest presents a feasible solution to all of the problems which the prior art foresaw but could not correct, or that it created itself. Compared to conventional irons or irons with heel-rests relying on weight, contours, or cushioning (e.g. rubber feet), the magnetic heel rest more effectively prevents an iron from tipping and falling from a vertical idle position. Unlike the solutions incorporating specially constructed iron-keepers, the magnetic heel rest does not require the user to always rest the iron in the same place, nor does it reduce the area or edge length of the board available for draping an article being ironed. Unlike the mechanical iron-lifting apparatus, the magnetic heel rest adds no significant size or complexity to the iron, nor does it change the motions required of the operator.

In conclusion, the present invention provides a technologically feasible, non-obstructing, convenient heel rest for an iron. Advantages include the prevention of damage to garments and work surfaces, and improved overall safety of use. Other aspects and example embodiments are provided in the figures and the detailed description that follow.

BRIEF DESCRIPTION OF THE DRAWINGS

FIG. 12 is a table summarizing the test results of the experiment illustrated in FIG. 11.

Figure 1:
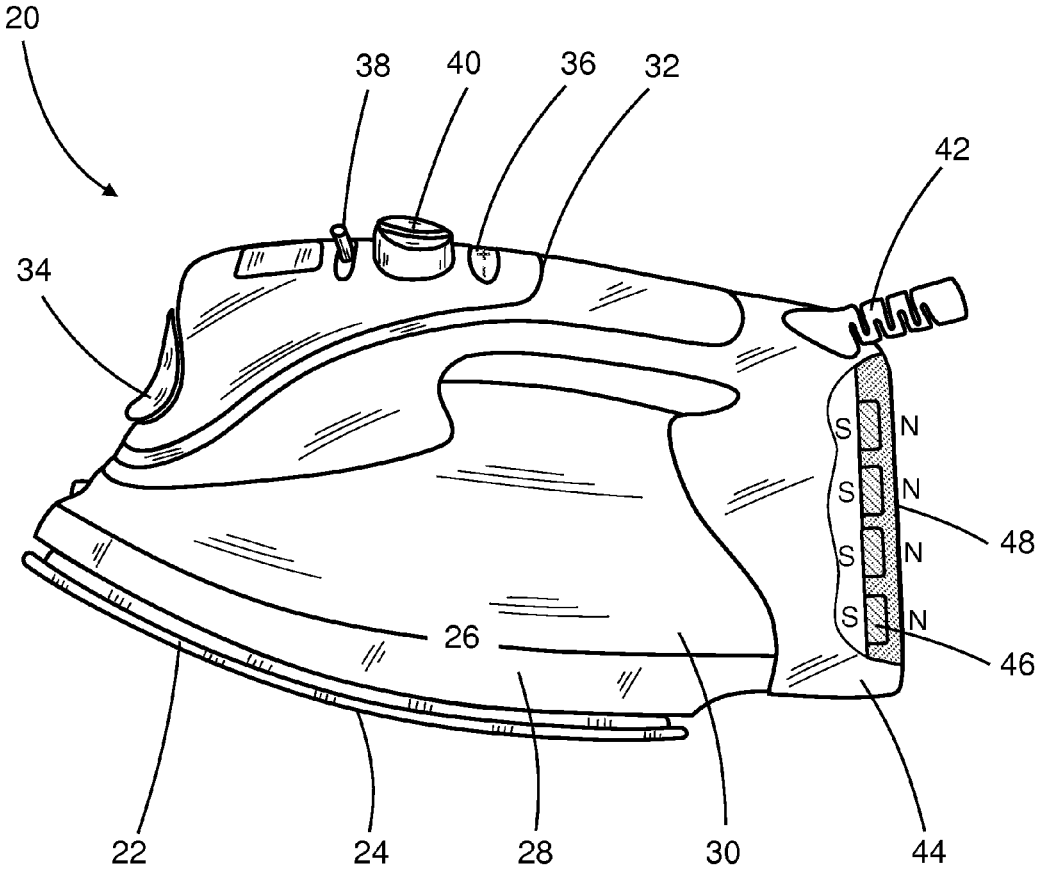
FIG. 1 is a perspective view of an iron with a magnetic heel rest, shown in the horizontal position used for actively ironing and including a cutaway showing the magnets inside the heel rest.

These drawings illustrate some of the possible variations of magnetic heel rests. However, the claims are intended to cover all modifications, equivalents, and alternatives falling within the spirit and scope of the disclosed concepts.

DETAILED DESCRIPTION

In the following description, similar components are referred to by the same reference numeral in order to simplify the understanding of the sequential aspect of the drawings.

Figure 2:
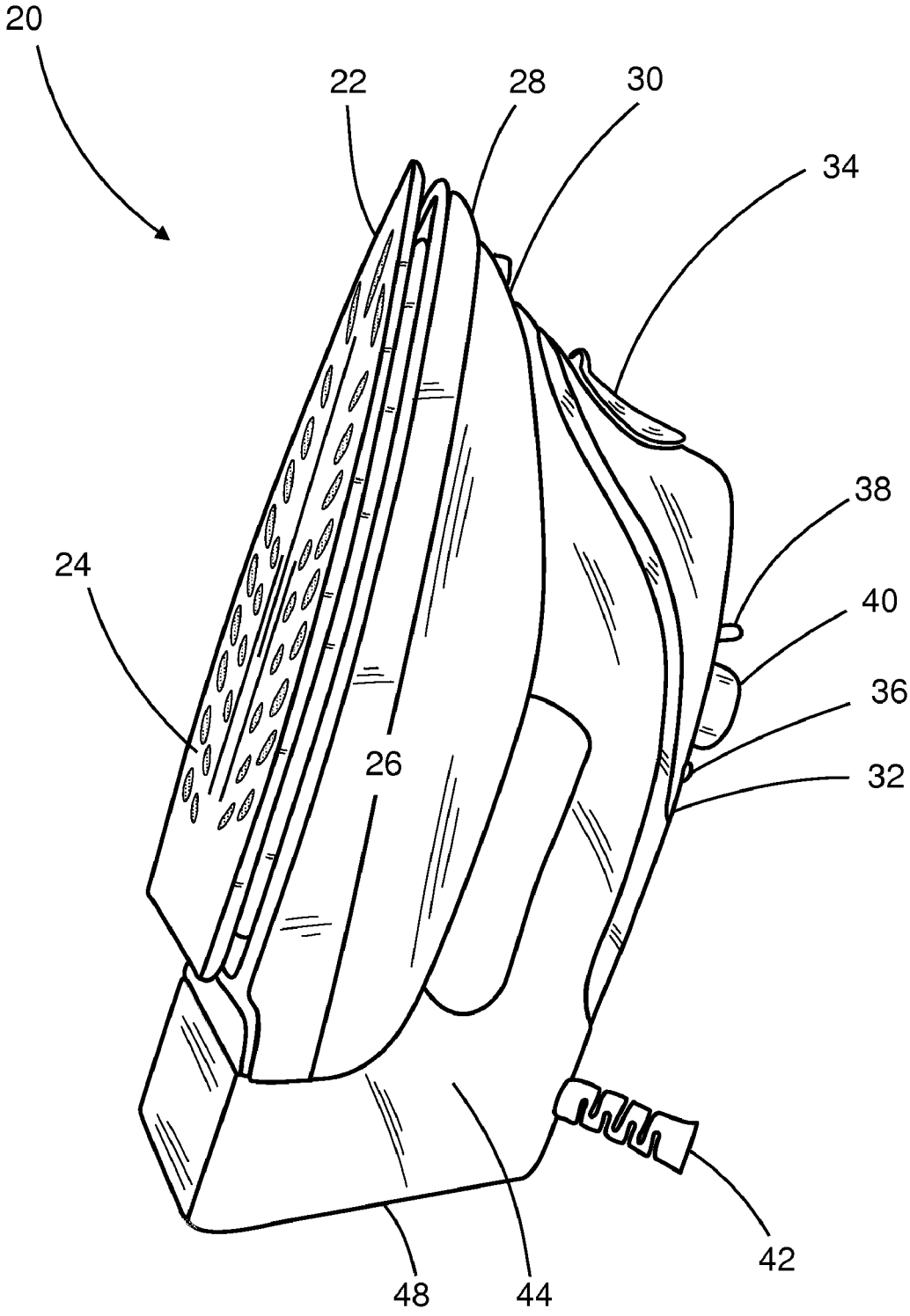
FIG. 2 is a perspective view of the iron standing vertically on its magnetic heel rest.
Figure 3:
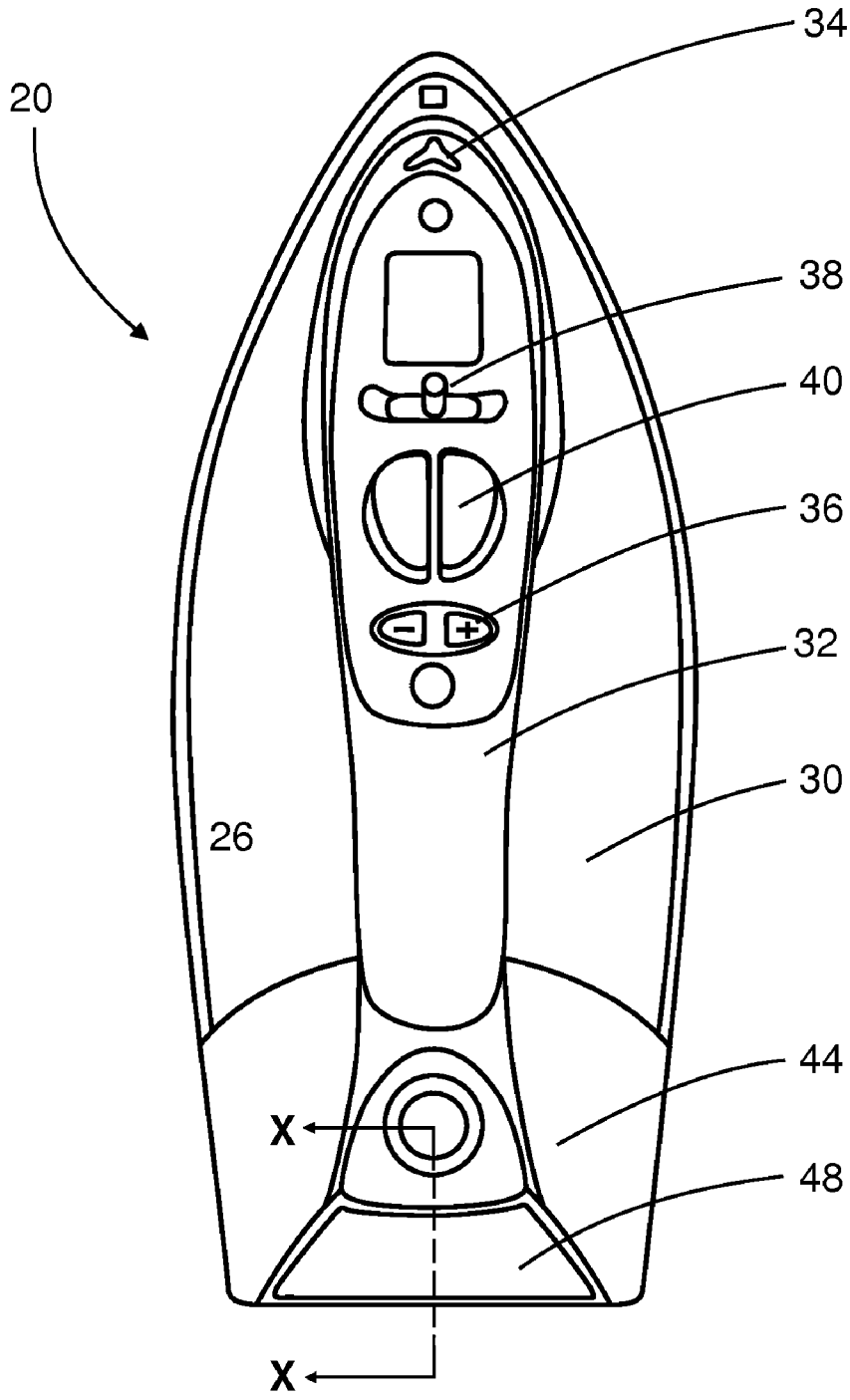
FIG. 3 is a top plan view of the iron.
Figure 4:
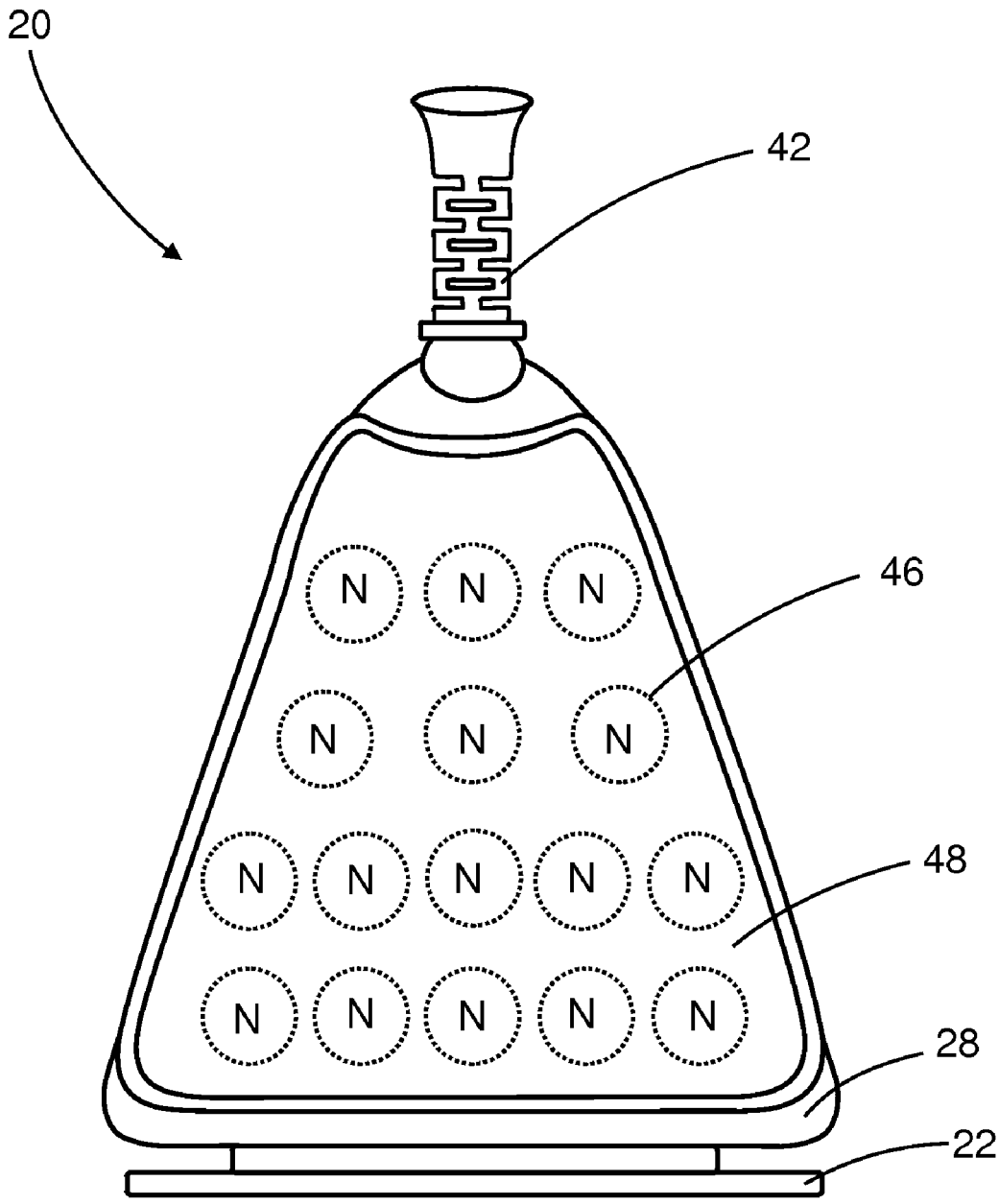
FIG. 4 is rear view of the iron, looking directly at the magnetic heel rest.

An improved heel rest enables an iron to rest securely, in a vertical orientation, anywhere on the top surface of an ironing board during those frequent rest periods in the ironing process while the article being ironed is shifted or changed, or while the operator momentarily attends to something else. The heel rest prevents the iron from tipping, no matter where on the ironing board the iron is placed, using the attraction of permanent magnet pieces to the ferromagnetic steel top of an ironing board FIGS. 1-4 show various views of an iron with a stable heel rest. FIG. 1 is a perspective view of the iron in the horizontal position, as it would engage with an article being ironed. FIG. 2 shows the vertical orientation, in which operators are accustomed to positioning idle irons. FIG. 3 is a top plan view and FIG. 4 is a rear view. Iron 20 includes a heatable soleplate 22 with a bottom face or pressing surface 24 in contact with an article to be ironed. A body 26 comprises a skirt 28, a water tank 30, and a handle 32; soleplate 22 is attached to the underside of body 26. Skirt 28 covers internal components such as heating elements and control circuits. Water tank 30 may be filled with an aqueous solution to provide droplets, steam, or both through holes in soleplate 22 to help release wrinkles from the article being ironed. A fill door 34 covers a fill opening in water tank 30. Handle 32 is designed to be grasped by the operator and may also support a temperature control dial or button 36, an automatic steam control 38 and a manual steam control 40. A line cord 42 provides a source of electric power.

A magnetic heel rest 44 is coupled to the body 26 at the heel end of the iron. The heel, which is the end perpendicular to the axis of handle 32 and closest to the center of gravity, is the surface on which operators are accustomed to resting an idle hot iron. When iron 20 is tilted out of the ironing position in that direction, the next stable resting position is for the iron to balance on the bottom of heel rest 44. In this position, the back end of heated soleplate 22 is lifted far enough off the ironing board to prevent delivering a potentially damaging amount of heat to the board under some defined worst-case condition (e.g., 30 minutes with the iron at its highest heat setting).

Heel rest 44 prevents the iron from tipping because one or more magnets 46, mechanically coupled to heel rest 44, are attracted to the steel in the top of a typical ironing board when the iron is resting vertically as in FIG. 2.

Experiments have shown that magnet parameters can be calculated such that the attraction is strong enough, even through a padded ironing board cover, to hold the iron steady if the board wobbles or tilts or if the iron is casually bumped. However, unlike weighted heels and iron lifters, the magnetic heel rest does not impede the operator's normal ironing motions. The magnetic force F from a magnet with vector magnetic moment m in a magnetic field B goes as $F=\nabla(m\cdot B)$. The dot product at any point in space is a scalar $mB\cos(\theta)$, where $\theta$ is the angle between m and B. For the heel rest, $\theta$ is 90° minus the angle between the magnet-attracting steel top of the ironing board and the dipole of the heel-rest magnet. When the iron rests on its heel, the dipole is perpendicular to the steel top of the board; $\theta=0$ and $\cos(\theta)=1$ for the strongest possible magnetic force to prevent the iron from tipping by itself. Additionally, magnetic field B between the magnet and the steel top of the ironing board diminishes as the inverse square of the distance between them.

Operators returning the iron to horizontal to resume ironing typically do so by tilting the iron off its heel rather than lifting straight up. As long as the maximum force exerted by the magnet is less than about 50 N, an operator purposefully gripping the handle exerts much more force than a typical moderate bump, wobble, or tilt of the board and can easily tilt the iron off its heel. As $\theta$ decreases, the magnetic force falls off approximately as $\cos(\theta)$ (approximate because the magnet may not be precisely at the iron's pivot point). At the same time, the distance between the magnets and the board increases. When the iron is horizontal as in FIG. 1, the dipoles of the heel-rest magnets 46 are parallel to the steel top of the board, $\theta=90°$, $\cos(\theta)=0$, minimizing the angular-dependent magnetic field. Also, when the iron is horizontal the magnets are lifted far enough away from the board that the magnetic pull force becomes negligible for practical purposes.

The heel rest 44 in FIGS. 1-4 can be manufactured integrally with handle 38, skirt 28, water tank 30, or even as an offset extension of soleplate 22. Alternatively, it may be fabricated separately and secured to a rear end of water tank 30 and a portion of the top of the handle assembly 32 by a snap fit or other arrangement. A similar heel rest could be fabricated onto, or secured to, the body of a dry iron that has no water tank. The line cord 42 may be secured to the magnetic heel rest 44 as shown here, or alternatively it may pass through a hole in heel rest 44 or be secured to body 26 at some other point. The present invention is also compatible with cordless iron arrangements and in such cases the line cord 42 would be omitted. "Docking" connections to an off-board heater, as seen in some very lightweight cordless irons, can be accommodated elsewhere on the heel or handle, or even on the side of the iron body.

Figure 5:
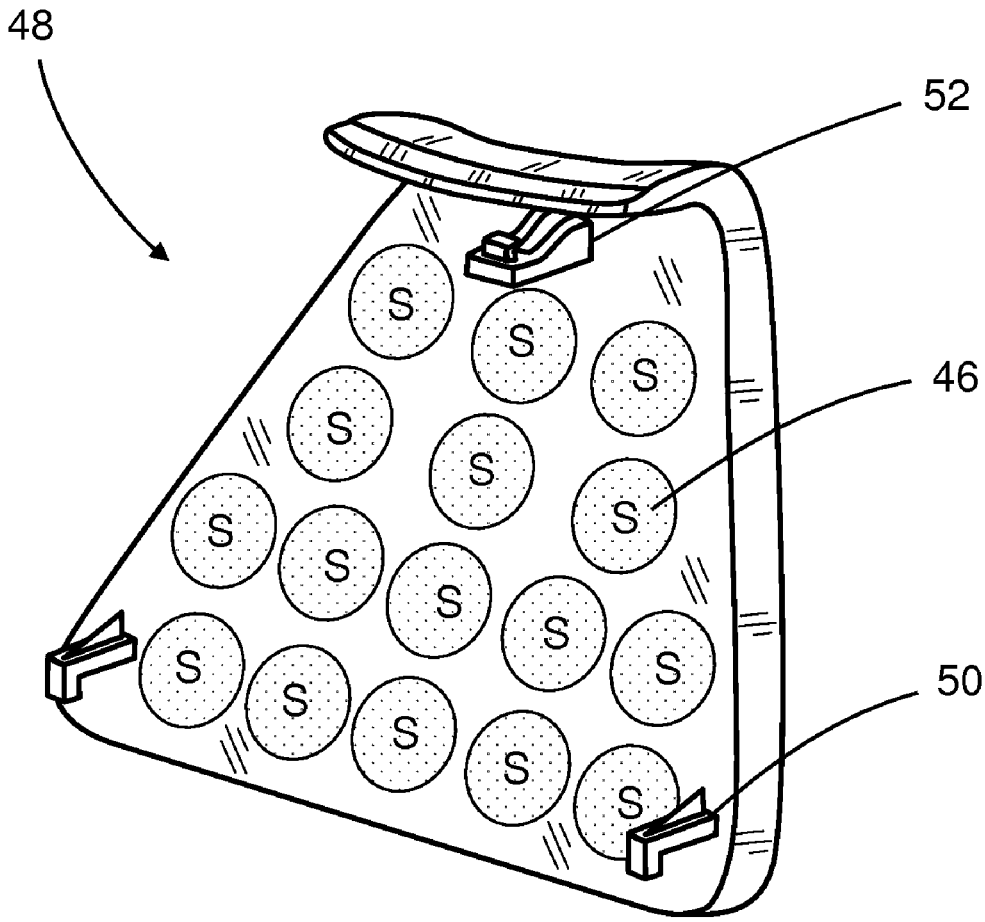
FIG. 5 is a perspective view of an exemplary rear plate for the heel rest.
Figure 6:
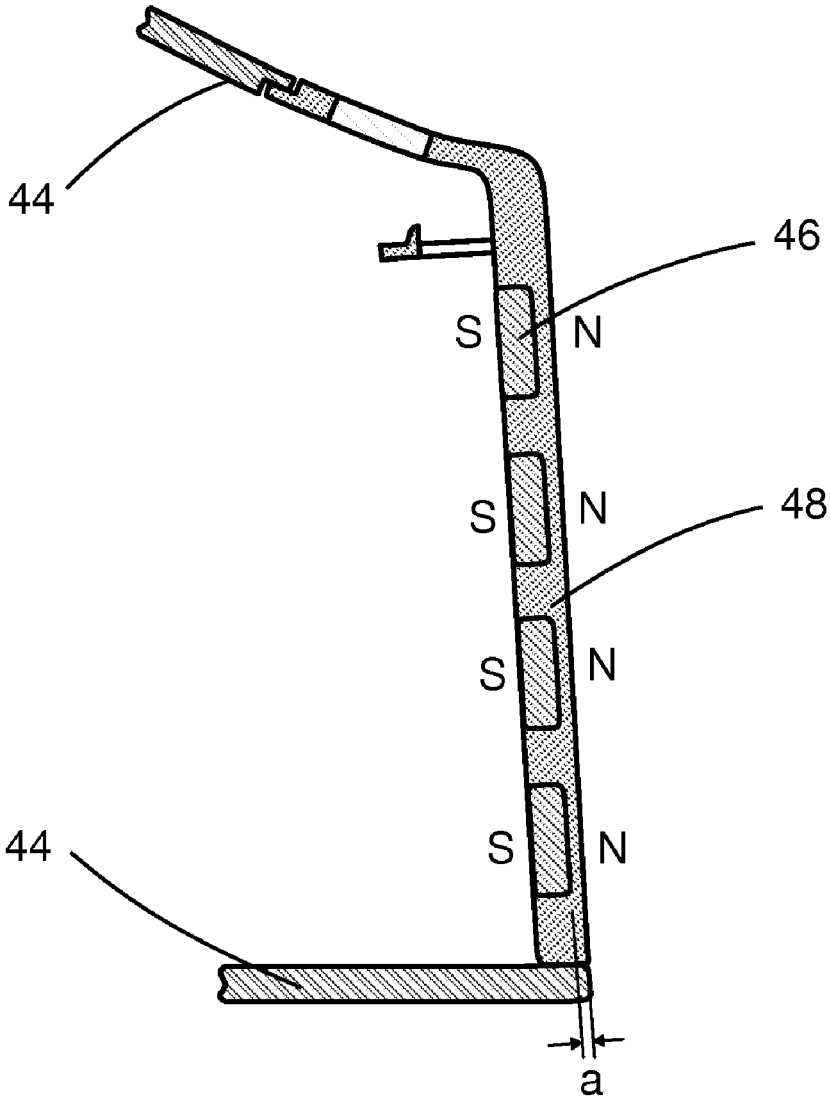
FIG. 6 is a partial cross-section along line X-X of FIG. 3, showing an example of a heel rest with the rear plate flush with its outer surface.

FIGS. 5 and 6 are views of the rear plate assembly of an exemplary heel rest. FIG. 5 is a perspective view and FIG. 6 is a cross-section along a line corresponding to X-X' in FIG. 3. A rear plate assembly 48 holds a magnetic component 46, which may be either a single magnet or an array of magnets. When the iron is tilted to a vertical "idle" position, rear plate assembly 48 is substantially parallel to the underlying ironing board, and close enough to the board surface that magnetic attraction occurs through the board cover. In FIGS. 4 and 5, rear plate assembly 48 has a trapezoidal footprint with rounded corners: a fairly convenient shape to cut or mold, imparting a streamlined appearance. However, any footprint shape such as square, triangle, polygon, oval, or circle may be utilized. The rear plate assembly 48 may contain tail pieces or protrusions, 50 and 52, to engage mating features on the body of the iron or on a cover or frame of the heel rest. Any other practical number or shape of tail pieces or protrusions 50, 52, however, can be used to fasten the rear plate assembly 48 to suitable parts of the heel rest or iron. In addition, other means for fastening the rear plate assembly 48 to the heel rest or iron are also contemplated, e.g. screws, nails, clips, flanges, etc.

The rear plate assembly 48 may be adapted to be fastened to any type of iron. In addition, the rear plate assembly having the magnet 46 may be made of any material such as ABS plastic, polypropylene, wood, metal, etc. In embodiments with more than one magnet 46, the magnets may be aligned with matching or opposing polarities. When ferromagnetic material is selected for the rear plate assembly 48, shunting effect of the magnetic field by the ferromagnetic plate material is expected if magnetic pieces aligned to opposite polarities are used together.

Figure 7A:
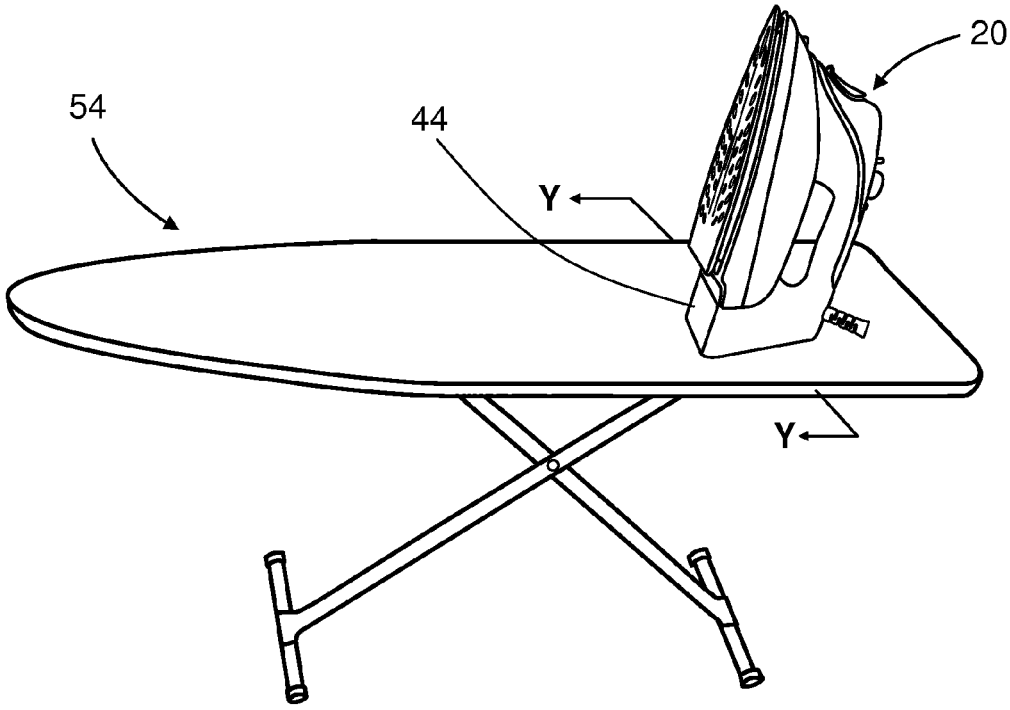
FIGS. 7A and 7B are a perspective view and a partial cross-section, respectively, showing how the heel rest engages the magnet-attracting steel ironing board surface through a padded cover.
Figure 7B:
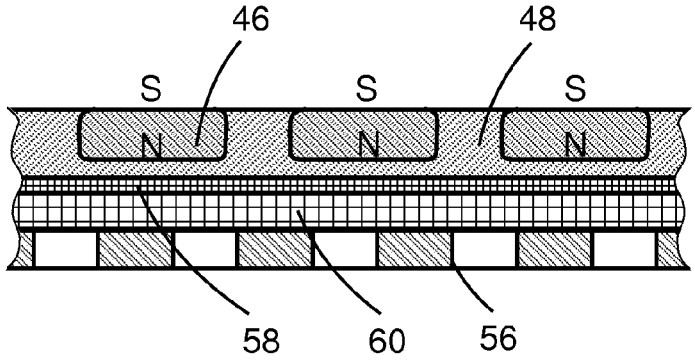

FIGS. 7A and 7B illustrate how the magnetic heel rest takes novel advantage of the fact that most of the ironing boards in residential and commercial uses have either a ferromagnetic steel mesh top, or a ferromagnetic steel sheet metal top with punched holes for optimum steam flow or reduced weight. Ironing board 54 includes ferromagnetic steel top 56, ironing board cover 58 and a padding/insulating layer 60 between the steel top and the ironing board cover. The ferromagnetic steel top 56 may be a magnetic stainless steel. Magnetic stainless steels, like any other ferromagnetic materials, are strongly attracted to magnets. Magnet 48, here shown as multiple permanent magnet pieces embedded in the heel rest, exerts a magnetic pull force on the ferromagnetic steel top 56 of an ironing board when iron 20 rests on the magnetic heel rest 44 in the upright position. The magnetic pull force between the permanent magnet pieces in the magnetic heel rest 44 and the ferromagnetic steel top of an ironing board will keep the iron securely on the ironing board to prevent the iron from tipping over or slipping. This magnetic heel rest does not need the rubber feet often included on conventional heel rests to provide a mechanical cushion against tipping. The magnetic force prevents tipping more effectively than mechanical cushioning, and the magnetic heel rest can be made of longer-wearing, easier-cleaning material than rubber or similar elastomers.

Numerous other ironing surfaces besides ironing boards are occasionally used for ironing when space or time is tight. Many such surfaces, however, are likewise ferromagnetic: the tops of washers, dryers, and many utility counters or carts. The operator typically uses a towel or blanket to pad the alternative ironing surface; just as the magnets hold the iron to the board through the board cover, they will hold the iron to the alternative surface through the improvised pad. As another alternative, a cover for a non-steel ironing board could incorporate a magnet-attracting layer such as steel mesh or a sewn-in array of thin steel plates.

Available materials for the magnet 46 include ferrite, neodymium iron boron, samarium cobalt, and Alnico (metal alloys composed primarily of aluminum, nickel and cobalt, and iron). In one particular embodiment, a ferrite magnet, also known as a ceramic magnet, may have the following benefits: inexpensive yet high magnetic pull strength, resistant to demagnetization, and non-rusting. The major raw material used to manufacture ferrite magnets is iron oxide, more commonly known as "rust", which is very inexpensive. High-temperature magnetic materials are not required in embodiments like those in FIGS. 1-7 because the magnets 46 are located far enough from the heated soleplate that their temperatures seldom exceed approximately 50° C., even during the ironing operation. No surface treatments are necessary for ferrite magnets since they are essentially inert and do not oxidize. However, they can be coated with various epoxy coatings for soil resistance and ease of cleaning.

The number and size of the magnet pieces used in the heel rest depends on the magnetic strength of the magnet pieces and the available surface area of rear plate assembly 48. Magnets of various sizes can be embedded in rear plate assembly 48 to maximize the usage of its surface area for encasing as much of the magnetic material as possible. In one embodiment, fewer magnet pieces of larger sizes may be less cost-effective than more magnet pieces of the smaller size. In another embodiment, thicker magnet pieces may be used to produce a stronger magnetic field and reduce the surface area required for rear plate assembly 48, for example in a compact travel iron.

In one embodiment, a ceramic disc magnet may be used as the magnet in the magnetic heel rest 44. In an example of this embodiment, multiple ceramic disc magnets having a particular magnetic strength were used in the iron rest to provide an electric iron that is very resistant to tipping. For a ceramic disc magnet measuring 19 mm diameter by 4.8 mm thick with magnetic strength Br of 2,000 gauss, the magnetic flux density on the centerline of a disc magnet is 403 gauss at 1.5 mm distance, and 351 gauss at 2.5 mm distance from the surface of the magnet. The outer surface area of a typical iron rest is 40-100 $cm^2$ and such an iron rest can easily fit 10 pieces of ceramic disc magnets with each piece measuring 19 mm diameter and a total surface area of approximately 28.5 $cm^2$. The pull force between 10 pieces of the ceramic disc magnets of the size mentioned above and a flat, ground mild steel sheet or plate is approximately 12 N when they are in direct contact. However, with a gap of typically 1-3 mm between the magnetic heel rest and the steel top of the ironing board due to the recess of the magnet pieces inside the heel rest and the thickness of the fabric cover and padding layer on the top of the flat steel board, the actual pull force when using those 10 ceramic magnet pieces will be less, say 5-10 N, which is still sufficient to make an iron very resistant to tipping.

Magnet pieces 46 may be mounted onto the rear plate 48 of the magnetic heel rest 44 by, for example, press-fitting, epoxy bonding, or any other conventional means for fastening. If using magnets that can withstand the required temperatures, the rear plate may be blow-molding or injection-molded around them. They can either be flush with the flat exterior surface of the rear plate 48 and visible in the final assembled form, or slightly recessed (a>0 mm in FIG. 6) and embedded inside the rear plate 48. The magnetic pull force will be slightly lower when the magnet pieces are recessed, i.e., further away from the ferromagnetic steel top of the ironing board when the iron is resting vertically on an ironing board.

Additionally, a user does not feel any significant difference between using an iron with a magnetic heel rest and an iron with a conventional non-magnetic heel rest. This is because embodiments of this invention maintain the compact size and light weight of a cloth iron with integrated magnetic heel rest 44. A typical magnetic heel rest 44 has similar surface area as that of the rear surface of a conventional iron, and it is typically 6-12 mm thick to accommodate the height or thickness of the permanent magnet pieces and the fastening means.

The appropriate amount of magnetic pull force between the magnetic heel rest 44 of an iron and the steel top 56 of an ironing board can be a personal preference for the user. The amount of recess, up to 10 mm, of the magnetic heel rest 44 with respect to the outer surface of the magnetic heel rest 44 can be made adjustable, with the shallowest recess providing the strongest magnetic pull force for keeping an iron from tipping. The recess can be adjusted by making at least a magnet-containing part of the rear plate movable relative to an outer frame of the heel rest. The magnetic pull force decreases with both distance and angle away from the dipole.

Therefore, adjusting the position of one or more magnets relative to the rear plate, or the recess depth, changes the peak magnetic pull strength but preserves the desirable angular dependence of the magnetic pull force: that is, strong attraction between the iron and board when the iron rests on its heel, little or no attraction when the iron rests on its soleplate.

Figure 8:
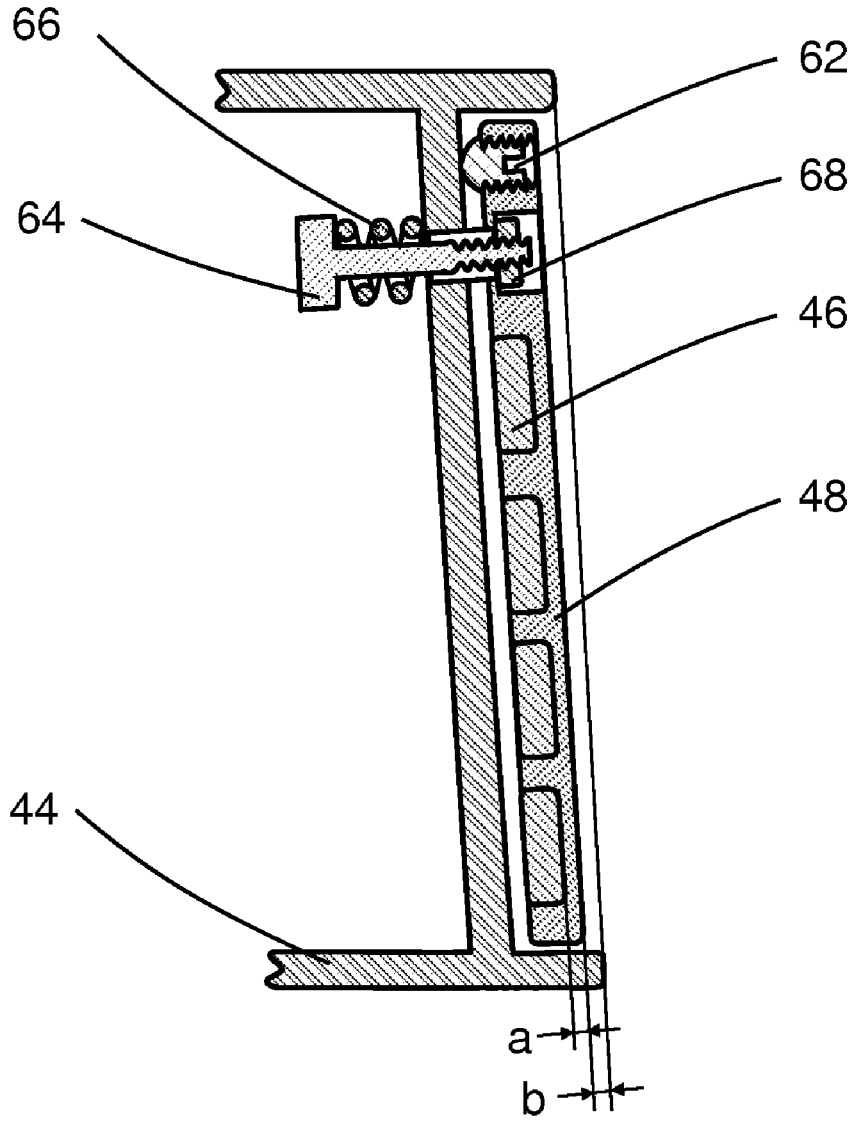
FIG. 8 is a partial cross-section along line X-X of FIG. 3, showing an example of a heel rest with its rear plate recessed, where the recess depth (and thereby the magnetic field strength) is operator-adjustable using set screws and spring-loaded bolts.

FIG. 8 illustrates an embodiment with operator-adjustable magnetic pull strength. Set screws 62 are used for adjusting the recess depth (b=0-10 mm) while assemblies consisting of bolt 64, hold-down coil spring 66 and nut 68 can be used to secure the rear plate 48 to the magnetic heel rest 44. To maintain a uniform recess of the magnetic rear plate on the heel rest in this particular embodiment, at least three set-screws 62 and three spring-loaded bolt assemblies, 64, 66 and 68, need to be included in the adjuster, preferably near the outer edges of, the rear plate 48.

Figure 9A:
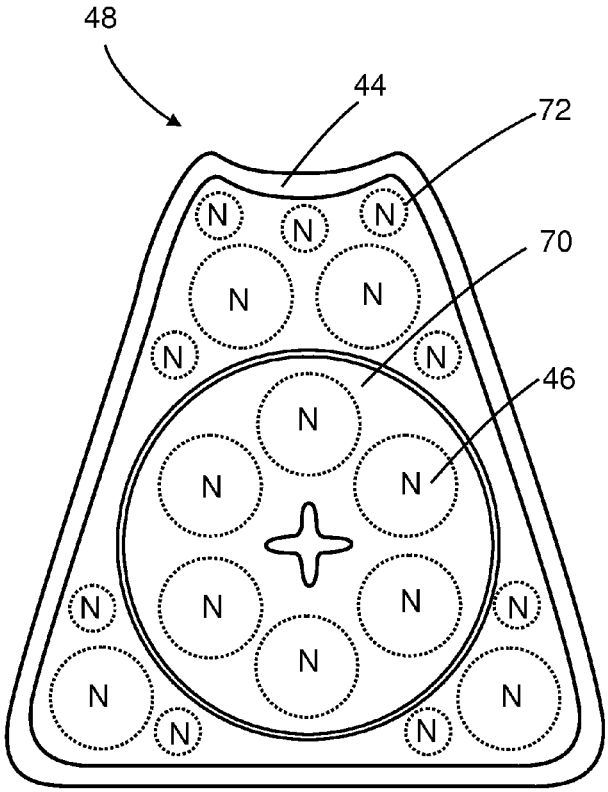
FIGS. 9A and 9B are a rear view and a cross-section along line X-X of FIG. 3, respectively, of another heel rest with an adjustably recessed disc-shaped center piece.
Figure 9B:
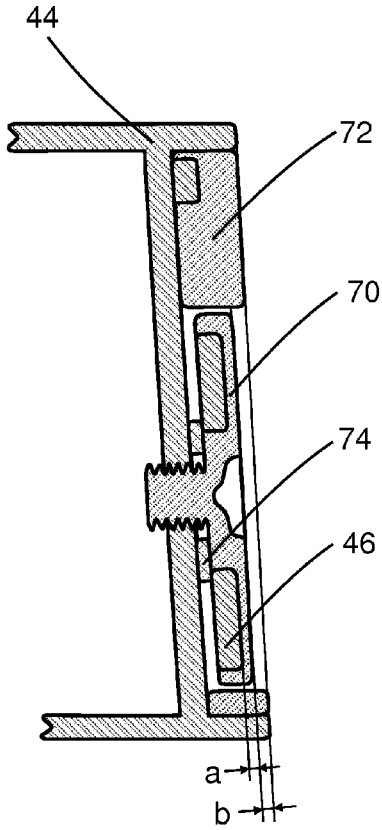

FIGS. 9A and 9B depict an alternative embodiment of adjustable magnetic rear plate 48 which includes two portions: an adjustable disc-shaped portion 70 containing magnet pieces and a fixed portion 72 which may or may not contain magnet pieces. Fixed portion 72 can be flush with magnetic heel rest 44 to provide a flat support base for the iron. The amount of recess of the disc-shaped portion 70 with respect to the fixed portion 72 and rear plate 48 can be easily adjusted by turning a simple adjuster: the threaded screw part located in the center of disc 70. The disc 70 rotates with the screw, and the progression of the threads with rotation moves the magnets in the disk relative to the fixed portion or outer frame, changing the recess depth of disc 70 and thereby the magnetic pull force of the heel rest. The relatively large diameter of the center adjuster screw will help keep disc 70 evenly recessed with respect to fixed portion 72, and a spring washer 74 is used between disc 70 and heel rest 44 to prevent disc 70 from turning and loosening by itself.

Figure 10A:
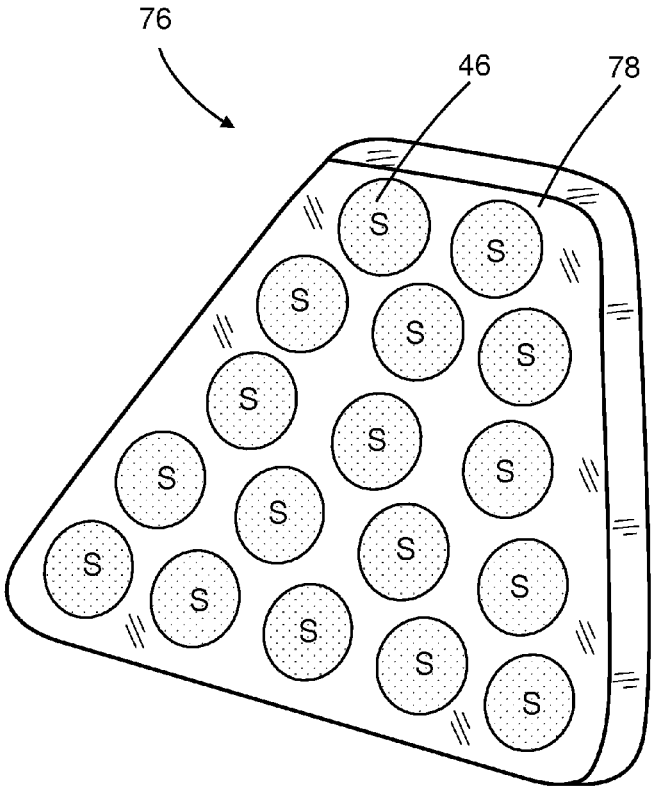
FIGS. 10A and 10B are a perspective view and a cross-section, respectively, of a stand-alone magnetic rear plate for attachment with an existing iron.
Figure 10B:
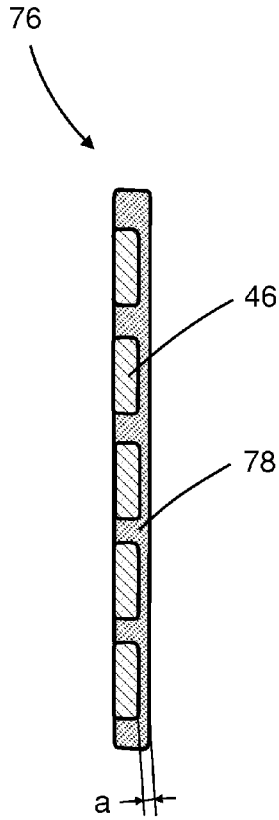

For existing irons which do not have a magnetic heel rest 44 as disclosed in this invention, a stand-alone prefabricated magnetic plate of suitable size and shape can be attached to the heel rest of an existing iron by conventional fasteners. For example, durable double-sided mounting tape or bolt/screw joints already present in the heel rest of the iron can be used to attach the magnetic rear plate to the heel rest. The bolts or screws may have to be replaced with longer ones to accommodate the newly added magnetic heel rest, and clearance holes have to be added on the magnetic plate accordingly. FIGS. 10A and 10B are a perspective view and a cross-section, respectively, of a trapezoidal magnetic plate 76 containing disc-shaped magnetic pieces 46 embedded in a flat plate 78 which may be made of any material such as ABS plastic, polypropylene, wood, non-ferromagnetic metal, etc. The magnet pieces can be recessed (a>0 mm). Some irons have rubber feet or ridges on the heel rest to prevent iron slippage. To attach a magnetic plate to such irons using adhesive tape, either the rubber feet may be removed or adhesive tapes with thickness greater than the height of rubber feet may be used around the rubber feet to ensure the magnetic plate is properly adhered to the heel rest. Other fastener types, including but not limited to industrial-strength hook-and-loop textures (e.g. Velcro™) and snap-on or screw-on clamps may secure the add-on heel rest to an existing iron if appropriate.

One distinct advantage of using magnetic forces to keep iron from tipping over is that the magnetic pull force, different from a constant dead weight added to the iron, decreases dramatically as the user tilts/lifts the iron and increases the gap between the magnetic heel rest of an iron and the ferromagnetic steel top of an iron board. In other words, the magnetic pull force is momentary while the iron is lifted away from the ironing board, and the user does not feel the need for much extra effort for lifting an electric iron with the magnetic heel rest from the ironing board as compared with lifting a regular iron without the magnetic heel rest.

Another advantage of using magnetic force to keep iron from tipping over is that much smaller magnetic pull force can counterbalance greater gravitational force of the iron. The magnetic pull force distributed over the surface area of an iron rest in contact with the ironing board is always on the same side of the pivoting point in the case of iron tipping irrespective of which way the iron is tipping over. By contrast, the gravitational forces (i.e., weight) of different components of the iron can be at either the same side or the opposite sides of the pivoting point in the case of iron tipping, i.e., there is some degree of self-balancing of an iron resting vertically on an ironing board. Typical electric irons weigh 1.5-3 kg including the weight of the water in a fully filled tank (typically ~0.3 kg). In the event of likely tipping of an iron, magnetic pull force of 4-10 N is generally adequate to counterbalance the gravitational force of the iron with its high center of gravity and keep iron securely on the ironing board. Greater magnetic pull force can help hold the iron more firmly on the ironing board, but it will present some challenges for a user with arthritis or weak arms to lift up the iron from the ironing board by overcoming the magnetic pull force and the weight of the iron.

A cloth iron with a magnetic heel rest as described herein is not likely to cause the operator any additional strain while using or transporting the iron, compared to a conventional model. If an iron with a magnetic heel rest is left standing vertically on a washer or drier in the laundry room or in close proximity with any other ferromagnetic steel or iron surfaces (e.g. a steel utility shelf), the magnetic pull force is generally less than 50 N which is not too large for a user to overcome and iron can be pulled away with ease. Likewise, when an article containing ferromagnetic material is accidentally brought into contact with the magnetic heel rest, the magnetic pull force is not strong enough to pinch and hurt the fingers and hands of the user of the iron. It is further noted that the magnetic field near the soleplate surface is too weak to produce any noticeable magnetic pull force between the soleplate and an ironing board during ironing.

An experiment has been performed to determine the improved degree of stability on a tilting ironing board of an iron using a magnetic heel rest. Two brands of commercially available irons have been tested, and are designated as R1 and R2. As is typical of current household irons, they each weighed about 2 kg and their tip-to-heel length was about 2.5× the heel width. They were initially tested without any modification. Then a magnetic plate of the same size as the heel rest of the iron was glued to the heel rest of each iron. Irons R1 and R2 with the magnetic heel rest installed (designated as M1 and M2, respectively) were then subjected to the same test to evaluate the effect of the magnetic heel rest.

Figure 11:
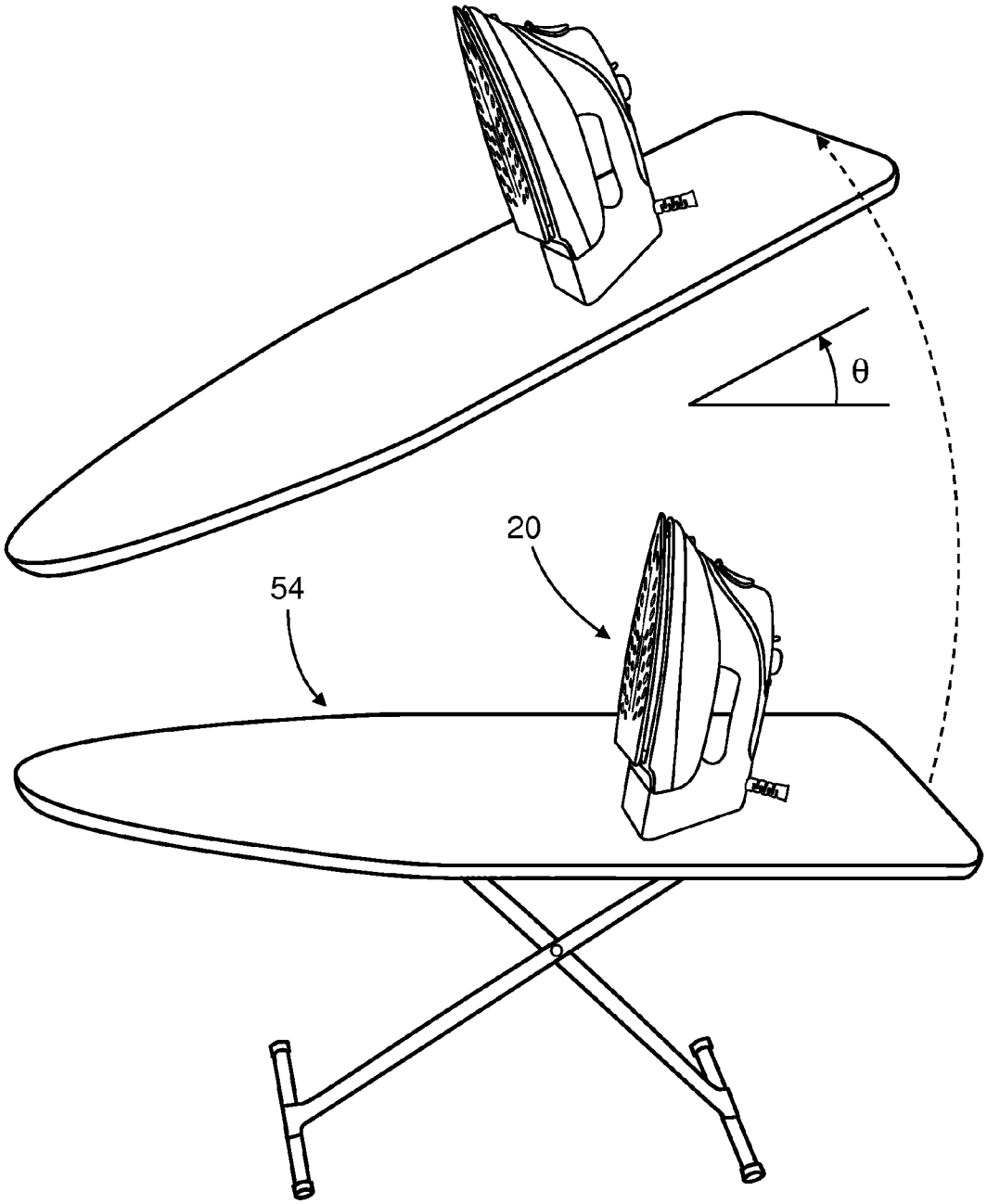
FIG. 11 is a perspective view of an experimental set-up used to measure and compare the balance stability of irons with and without magnetic heel rests.

FIG. 11 shows the test setup. Each iron's water tank was filled with water to its maximum level to produce the highest center of gravity the iron could have in normal use. Next, the iron was placed in an upright position on its heel rest on a standard household ironing board. The end of the ironing board nearest the handle of the iron was raised until the iron moved from its upright position to a horizontal position, i.e., tipped over. After the iron moved, the angle of the table top was lowered until the iron would stop moving, and thus the most accurate point of movement was found. The ironing board angle at which the iron tips over was then recorded. The test was performed four times, and the results shown in FIG. 12 are an average of all four tests for each of the irons.

As shown in FIG. 12, iron M1, which had the magnetic heel rest, tipped over when the ironing board was raised to an angle of 45 degrees. R1, the same iron without the magnetic heel rest, tipped over at an angle of only 15 degrees. Similarly, iron M2 which had the magnetic heel rest, tipped over when the ironing board was raised to an angle of 30 degrees while R2, the same iron without the magnetic heel rest, tipped over at an angle of only 11 degrees. Accordingly, the irons incorporating the magnetic heel rest was significantly superior to the two regular irons in remaining in an upright position.

The description above should not be construed as limiting the scope of the invention, but as merely providing illustrations to some example embodiments. In light of the above description and examples, various other modifications and variations may naturally occur to those skilled in the art without departing from the spirit and scope of the appended claims. Accordingly, the scope of the invention should be determined solely by the appended claims and their legal equivalents.

What is claimed is:

1. An apparatus for ironing, comprising:
an ironing surface comprising a magnet-attracting layer, and an iron comprising:
a body,
a heatable soleplate attached to the underside of the body,
a handle attached to the top of the body, and
a heel rest attached to the rear of the body, where
the heel rest comprises a magnet having a dipole oriented substantially parallel to the soleplate,
the magnet exerts a pull force on the magnet-attracting layer of the ironing surface when the iron is balanced on the heel rest with the soleplate in a substantially vertical orientation, and
the pull force is sufficient to prevent the iron from tipping in response to moderate bumping or tilting perturbations.

2. The ironing apparatus of claim 1, where the magnet comprises a material selected from the group of ferrite, neodymium iron boron, samarium cobalt, and Alnico.

3. The ironing apparatus of claim 1, where the magnet comprises a plurality of magnetic pieces embedded in a rear plate.

4. The ironing apparatus of claim 3, where the magnetic pieces are all aligned to the same magnetic polarity.

5. The ironing apparatus of claim 3, further comprising an adjusting mechanism configured to adjust the position of the magnet relative to the rear plate.

6. The ironing apparatus of claim 5, where the adjusting mechanism comprises a screw.

7. The ironing apparatus of claim 6, where the screw is attached to a disc-shaped portion of the plate that can rotate with the screw.

8. The ironing apparatus of claim 1, where the body of the iron further comprises a water tank mounted inside the body and configured to supply steam to the soleplate, where the heel rest is coupled to the body at the water tank.

9. The ironing apparatus of claim 1, where the magnet is configured such that the pull force on the magnet-attracting layer is between 5 and 30 newtons.

10. A heel rest for a cloth iron, comprising:
a plate,
a magnet attached to the plate,
a frame attached to the plate, and
a fastener attached to the frame for attaching the heel rest to the cloth iron, where attaching the heel rest to the cloth iron orients a dipole of the magnet substantially parallel to a soleplate of the cloth iron.

11. The heel rest of claim 10, where the magnet comprises a plurality of magnetic pieces embedded in the plate.

12. The heel rest of claim 11, where the magnetic pieces are all aligned to the same magnetic polarity.

13. The heel rest of claim 10, where the fastener comprises at least one of a screw, a snap, a clamp, an adhesive, and a hook-and-loop texture.

14. The heel rest of claim 10, where the plate is movable independently of the frame, and further comprising an adjuster to adjust the position of the plate relative to the frame.

15. The heel rest of claim 14, where the adjuster adjusts the position of the plate so as to change the magnetic field strength at a bottom surface of the heel rest.

16. The heel rest of claim 10, where the magnet is configured to exert a pull force of beyween 5 and 30 newtons on a magnet-attracting surface.

17. A means for stabilizing an iron, where the iron has a heel, comprising:
means for resting the iron on the heel,
means for generating a permanent magnetic field at the bottom surface of the resting means, and
means for attracting a magnet to an ironing surface, where
the permanent magnetic field is calculated to prevent the iron from tipping while resting on the heel, and
the permanent magnetic field generating means is positioned and oriented so as not to impede normal motions of ironing.

18. The stabilizing means of claim 17, further comprising means for adjusting the permanent magnetic field by adjusting the distance between the magnetic-field-generating means and the magnet-attracting means.

* * * * *